US005806090A

United States Patent [19]

Johnson

[11] Patent Number: 5,806,090

[45] Date of Patent: Sep. 15, 1998

[54] DIVING SUIT WITH STRETCHABLE WAISTBAND

[75] Inventor: Victor William Johnson, Surrey, Canada

[73] Assignee: FitzWright Co. Ltd., Langley, Canada

[21] Appl. No.: 833,956

[22] Filed: Apr. 11, 1997

[51] Int. Cl.[6] ..... B63C 11/04; A41F 1/00; A41D 13/00

[52] U.S. Cl. ..... 2/2.15; 2/87; 2/236

[58] Field of Search ..... 2/2.15, 2.17, 221, 2/237, 269, 70, 71, 72, 76, 79, 80, 82, 86, 87, 212, 213, 227, 229, 235, 236

[56] References Cited

U.S. PATENT DOCUMENTS

| | | |
|---|---|---|
| 1,461,798 | 7/1923 | Hildreth . |
| 1,476,831 | 12/1923 | Pease . |
| 1,677,663 | 7/1928 | St. Amour . |
| 2,582,811 | 1/1952 | Williams . |
| 2,722,010 | 11/1955 | Thielman . |
| 3,493,972 | 2/1970 | Oldham . |
| 3,731,319 | 5/1973 | O'Neill . |
| 4,464,795 | 8/1984 | Long et al. . |
| 4,535,477 | 8/1985 | Musto et al. . |
| 4,543,670 | 10/1985 | Ehring . |
| 4,573,218 | 3/1986 | Saggs . |
| 4,890,337 | 1/1990 | Greenberg . |
| 5,033,127 | 7/1991 | Schmeltz . |

FOREIGN PATENT DOCUMENTS

| | | |
|---|---|---|
| 471550 | 4/1969 | Germany . |
| 1139712 | 1/1969 | United Kingdom . |

*Primary Examiner*—C. D. Crowder
*Assistant Examiner*—Shirra L. Jenkins
*Attorney, Agent, or Firm*—John Russell Uren

[57] ABSTRACT

A diving suit has an upper torso portion and a lower torso portion. The upper and lower torso portions are connected and one is layered and folded upon itself in the waistband area. A stretchable waistband is connected to the upper and lower torso portions about the circumference of the diving suit on the inside of the diving suit over the layered area and allows the upper torso portion to move relative to the lower torso portion while the user is entering the diving suit and during operation thereafter. A recess in the waistband area accommodates the bottom of the zipper which extends diagonally across the forward torso portion.

14 Claims, 4 Drawing Sheets

DIVING SUIT WITH STRETCHABLE WAISTBAND

This invention relates to an underwater diving suit and, more particularly, to an underwater diving suit with a flexible and stretchable waistband which will accommodate users of different heights and allow more efficient access to the suit.

BACKGROUND OF THE INVENTION

Diving suits for underwater use are well known and have been in use for many years. Many of such diving suits are disclosed in patents and other documentation. A problem, however, with diving suits known to date is that there is inefficiency associated with manufacturing a diving suit which may be used for different users having different heights. Comfort is desirable so far as possible when working underwater and diving suits should be tailored to fit the specific users so far as possible. A further problem associated with diving suits is the ease of access to the suit. Typically, entry into a diving suit is tedious. More easily entering a suit is beneficial.

A diving suit according to the prior art is disclosed in U.S. Pat. No. 4,464,795 (Long). This reference teaches a diving suit which is lengthwise adjustable and wherein the length of the torso portion of the suit is longer than the torso of a diver so that the suit may fit a variety of users of different heights and wherein entry to the suit is facilitated. This is accomplished manually by one of two methods. The first method uses suspenders which are connected between the upper and lower torso portions of the suit on either side of the waist area of the user. The suspenders extend from the forward portion of the suit to the rearward portion over the shoulders and can adjustably lengthen or shorten the suit through a folded layer of material formed in the waist area. The second technique utilises a crotch strap extending between the legs of the user which, again, may adjust the length of the folded layer of material in the waist area of the diving suit. Extra material is required for the suspenders and the crotch strap and the extra material is not comfortable when being worn. Likewise, time is required to ensure the suit length is correct. This is disadvantageous.

A further type of adjustment for a suit is disclosed in German Document 471,550 (Hurzeler). This patent teaches a series of straps in the midsection area of the suit which allow the user some adjustment in the length of the suit. However, entry or access to the suit is through a zipper extending the length of the suit from the collar of the user to the crotch through the midsection. Zippers are generally not resilient or stretchable. Accordingly, the suit will not expand or lengthen after the zipper is fastened. Thus, while contraction is possible, it is required to adjust the suit to its maximum adjustable length when the zipper is fastened thereby allowing movement by the user not exceeding the length of the suit when adjusted. The process is complicated and the adjustability of the suit is compromised by the lack of a zipper allowing for lengthwise flexibility of the suit during operation.

Yet a further suit is disclosed in British Patent 1,139,712 (Oldham). Oldham teaches a zippered front area which zippered opening extends diagonally across the front the torso of the suit to allow for easier access. To allow the longitudinal expansion required for access by the user in slipping the suit over his head and to still maintain the suit in its desired length when worn, the suit utilises a zipper opening in the rear panel which allows the user to pull the neck of the suit over his head. The zipper in the forward and rearward panels are then closed after the suit is on the body of the user. The rearward zipper is somewhat difficult to operate and both zippers, when closed, do not allow longitudinal expansion of the suit.

SUMMARY OF THE INVENTION

According to one aspect of the invention, there is provided a diving suit comprising an upper torso portion and a lower torso portion operable to fit the body of a user, said upper torso portion being connected to said lower torso portion, a waistband panel extending between said upper torso and said lower torso portions and being connected at upper and lower attachment areas to said upper and lower torso portions, respectively, one of said upper and lower torso portions being layered in said waistband area between said upper and lower attachment areas, said waistband panel being resilient and stretchable so as to allow longitudinal expansion and contraction of said diving suit in said waistband area.

BRIEF DESCRIPTION OF THE SEVERAL VIEWS OF THE DRAWINGS

A specific embodiment of the invention will now be described, by way of example only, with the use of drawings in which.

DESCRIPTION OF SPECIFIC EMBODIMENT

Figure 1:
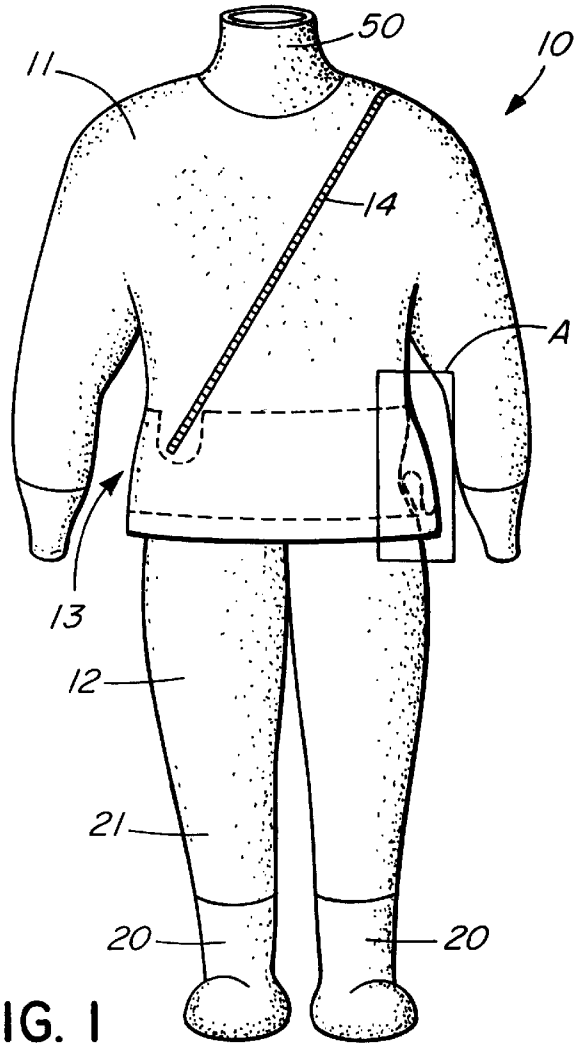
FIG. 1 is a front diagrammatic view of the diving suit according to the present invention.

Referring now to the drawings, a diving suit according to the invention is generally illustrated at 10 in FIG. 1. It comprises an upper torso portion 11 and a lower torso portion 12 which are connected together and which overlap in the waistband area 13 as will be described. A zipper 14 extends diagonally across the front panel of the upper torso portion 11 and opens to allow ingress to the suit 10 by the user. Waterproof boots 20 are connected to the legs 21 of the lower torso portion 12 as is known.

Figure 2:
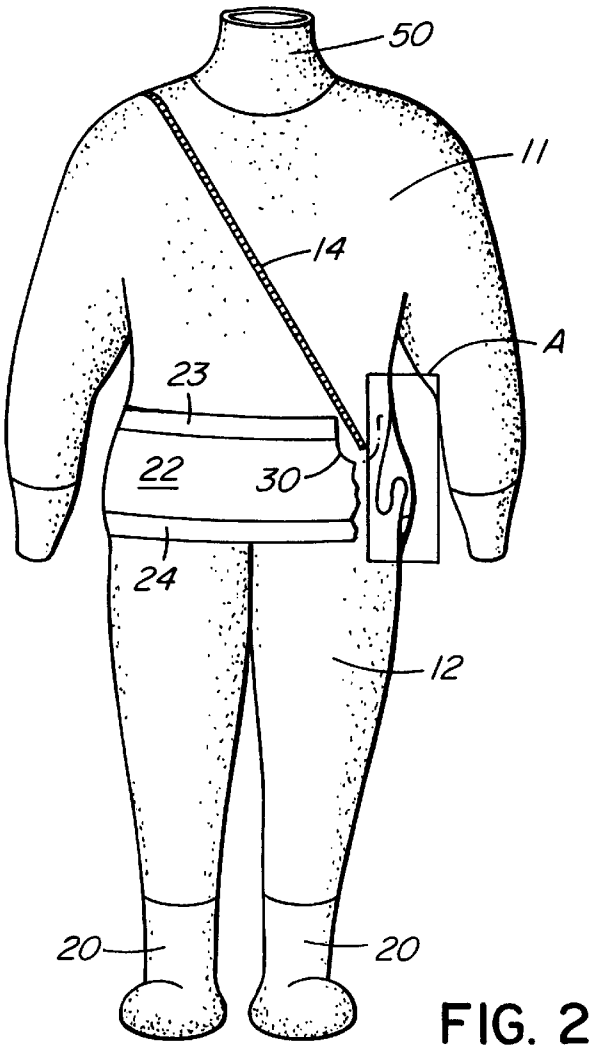
FIG. 2 is a diagrammatic view of the diving suit of FIG. 1 with the suit inside out and specifically illustrating the waistband panel according to the invention.

With reference to FIG. 2 illustrating the diving suit 10 turned inside out, a flexible and stretchable waistband 22, conveniently made from rubber, is connected to the upper and lower torso portions 11, 12 by using upper and lower sealing tape 23, 24, respectively, as will be described.

A recessed area 30 is formed in the waistband 22 and extends through the upper sealing tape 23. The recessed area allows for the zipper 14 to be accommodated by the flexible waistband 22 without interfering with the expansion and contraction of the waistband 22 and without interfering with the longitudinal expansion and contraction of the diving suit 10 as will be described.

Figure 3:
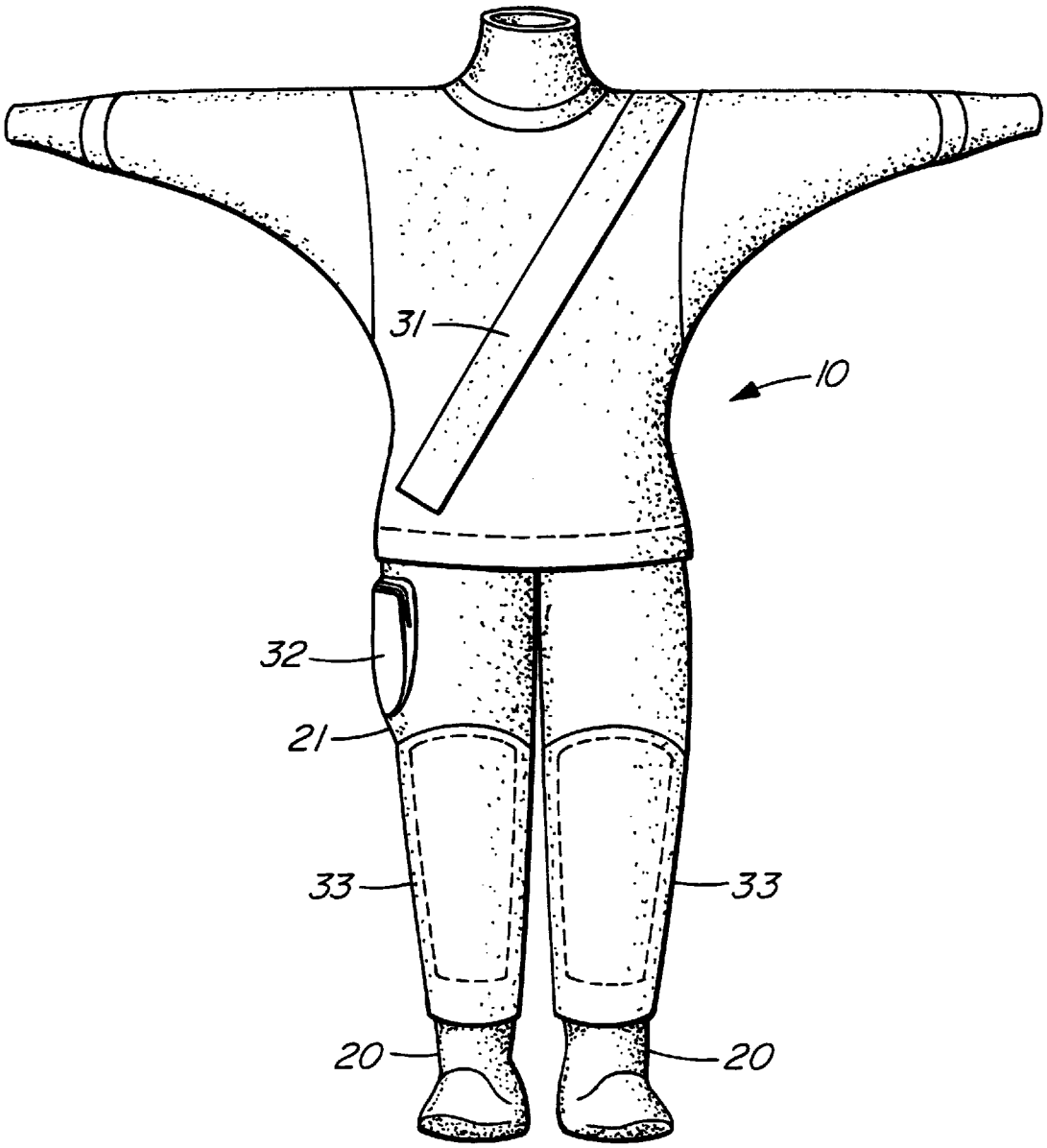
FIG. 3 is a front view of the diving suit according to the invention illustrating the suit in its completed configuration prior to being worn by a user.
Figure 4:
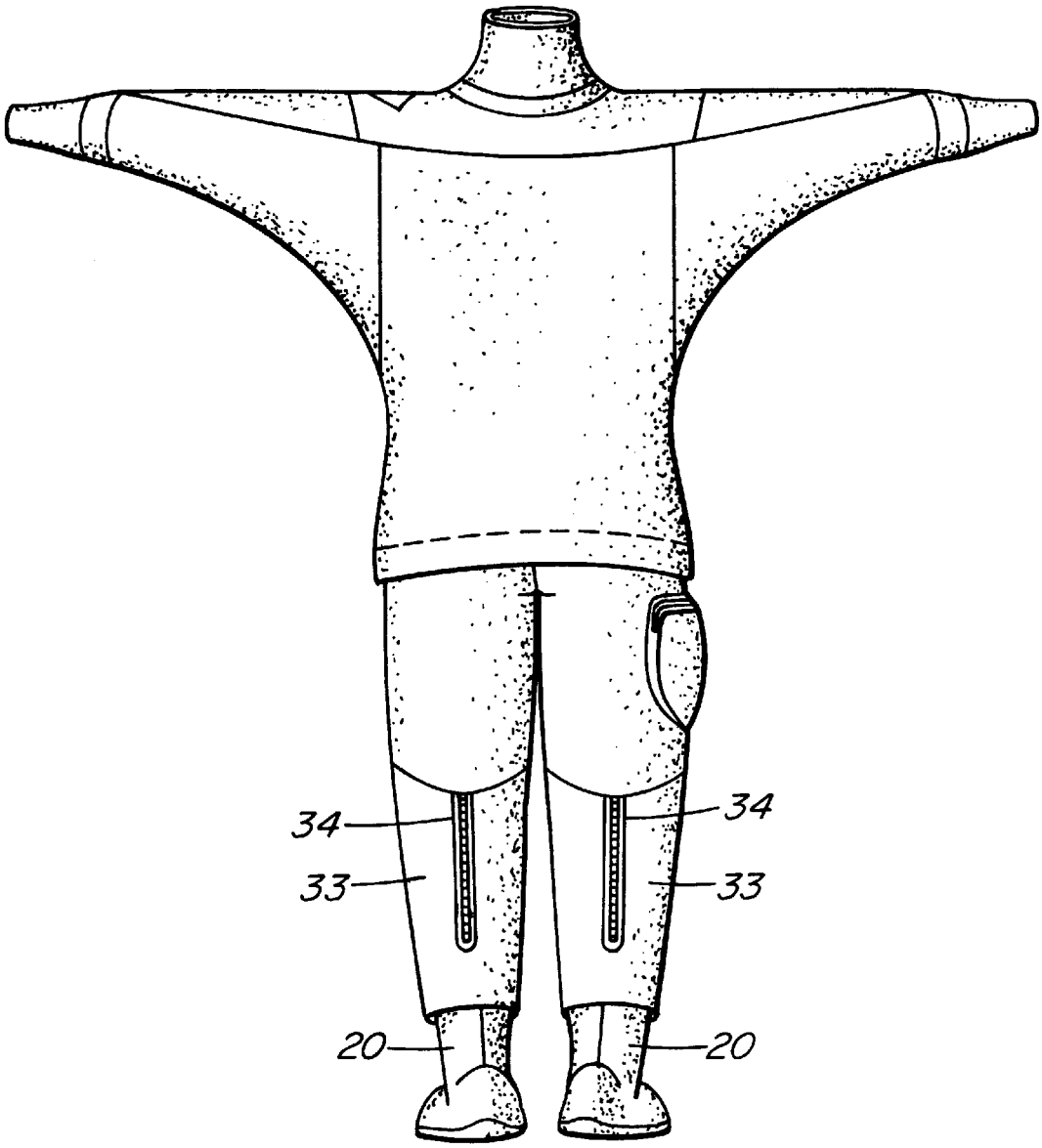
FIG. 4 is a rearward view of the diving suit of FIG. 3.

With reference to FIG. 3, the diving suit 10 is illustrated with a zipper panel member 31 covering the zipper 14. A pocket 32 is positioned on the outside right leg of the diving suit 10 and is used to hold various materials or tools as is known. Gaiters 33 are connected to the bottom of the legs 21 of the diving suit 10 between the tops of the waterproof boots 20 and the knee areas of the diving suit 10. The gaiters 33 each have a zipper 34 which creates a relatively snug fit between the gaiters 33 and the legs 21 of the diving suit 10 (FIG. 4). By closing the zippers 34, air within the suit 10 is prevented from entering the boots 20. If air was permitted to enter the waterproof boots 20, the buoyancy of the suit 10 could be such that the user would assume an upside down position which clearly may be undesirable.

Figure 5:
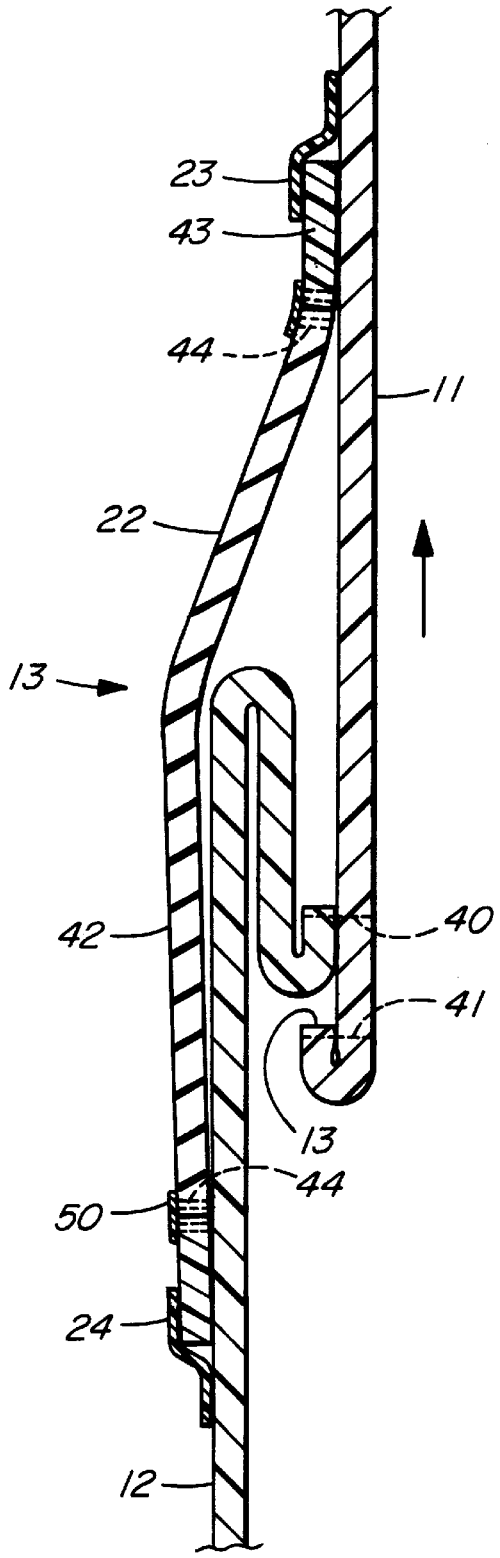
FIG. 5 is an enlarged cutaway view of the areas A in FIGS. 1 and 2 illustrating the waistband area according to the invention with the diving suit layered beneath the waistband.

With reference to FIG. 5, the upper torso portion 11 is connected to lower torso portion 12 using a single needle stitch 40. The end of the upper torso portion 11 is doubled over and likewise restrained in position using a single needle stitch 41. The lower torso portion 12 is doubled over or layered in the waistband area 13 about the circumference of the diving suit 10.

The waistband 22 includes a stretchband 42 which is stretchable and preferably made from rubber material. The waistband 22 is connected to garment fabric 43 of the same type of nylon material comprising the upper and lower torso portions 11,12 using a four(4) needle stitch 44 and elastic tape 50 overlaying the stitching 44. The waistband 22 is continuous and extends about the circumference of the diving suit 10. The upper and lower ends of the waistband 22 contact the upper and lower torso portions 11, 12 and sealing tape 23 extends between the waistband 22 and the upper and lower torso portions 11, 12. No stitching is presently in this area although it is contemplated that stitching directly through the suit would be appropriate if added length is needed to secure the waist band to the upper and lower portions. Thus, the waistband 22 may expand and contract allowing the upper torso portion 11 and the lower torso portion 12 to move longitudinally relative to each other and thereby allow the diving suit to automatically lengthen or shorten.

OPERATION

In operation and with reference to FIG. 2, the user will open zipper 14 to allow access to the interior of the suit 10. He will step into the legs 21 of the diving suit 10 and pull the neckband 50 over his head. While doing so, it may be necessary for the suit to stretch to accommodate the entry of the user.

The waistband 22, being made principally of the stretchband 42, will stretch and allow the upper torso portion 11 to move upwardly relatively to the lower torso portion 12 as viewed by the arrow in FIG. 5. When the neckband 50 is over the user's head and resting in its ultimate position about the neck of the user, the stretchband 42 will contract thus allowing the upper torso portion 11 to move downwardly relative to the lower torso portion 12 and assume the resting position illustrated in FIG. 5 although, of course, a taller user will require greater extension and less contraction of the waistband 22. The user will close the zipper 14 and, likewise, he will close the zippers 34 in gaiters 33 to prevent air within the suit 10 from entering the boots 20.

The stretchband 42 will allow the user greater freedom of movement while operating underwater. It will accommodate movement or bending by the user both in the forward and rearward areas while maintaining the correct length according to the height of the user. The use of the stretchable waistband 22 will allow the same diving suit 10 to be used for users of different heights according to the expansion and contraction limits of the waistband 22.

While a specific embodiment of the invention has been described, many modifications will readily occur to those skilled in the art to which the invention relates. Such description, therefore, should be taken as illustrative of the invention only and not as limiting its scope as defined in accordance with the accompanying claims.

I claim:

1. A diving suit comprising an upper torso portion and a lower torso portion operable to fit the body of a user, said upper torso portion being connected to said lower torso portion, a waistband panel extending between said upper torso and said lower torso portions and being connected at upper and lower attachment areas to said upper and lower torso portions, respectively, one of said upper and lower torso portions being layered in said waistband area between said upper and lower attachment areas, said waistband panel being resilient and stretchable so as to allow longitudinal expansion and contraction of said diving suit in said waistband area.

2. Diving suit as in claim 1 wherein said upper torso portion moves relative to said lower torso portion.

3. Diving suit as in claim 2 and further comprising a zipper in said upper torso portion.

4. Diving suit as in claim 3 wherein said waistband panel includes a stretchband overlaying said layered waistband area inside said diving suit.

5. Diving suit as in claim 4 wherein said upper torso is connected to said lower torso by stitching.

6. Diving suit as in claim 5 wherein one of said upper or lower torso portions is doubled over in said layered waistband area.

7. Diving suit as in claim 6 wherein said waistband comprises a stretch band and fabric connected to said stretchband on the upper and lower circumferences of said stretchband.

8. Diving suit as in claim 7 wherein said stretchband is connected to said fabric by stitching.

9. Diving suit as in claim 8 wherein said fabric on said upper and lower circumferences of said stretchband is connected to said upper and lower torso portions, respectively, of said diving suit.

10. Diving suit as in claim 9 wherein said fabric is connected to said upper and lower torso portions of said suit by waterproof sealing tape.

11. Diving suit as in claim 10 and further comprising a zipper in the forward portion of said diving suit.

12. Diving suit as in claim 11 wherein said zipper extends into said waistband area, said waistband including a recess to accommodate said zipper and being operable to avoid contact between said zipper and said waistband.

13. Diving suit as in claim 12 wherein said zipper extends diagonally across the forward portion of said diving suit, said recess in said waistband being on one side of the central axis of said diving suit.

14. Diving suit as in claim 13 and further comprising a gaiter connected to each leg of said diving suit, each of said gaiter having a zipper, said zippers each having open and closed conditions, said closed condition maintaining said gaiters in close contact with said legs of said diving suit and said open condition maintaining said gaiters in loose contact with said legs of said diving suit.

* * * * *